US009368886B2

(12) United States Patent
Kallee

(10) Patent No.: US 9,368,886 B2
(45) Date of Patent: Jun. 14, 2016

(54) MULTI-FORK PRESS-IN PIN

(75) Inventor: Werner Kallee, Bad Friedrichshall (DE)

(73) Assignee: Würth Elektronik ICS GmbH & Co. KG, Öhringen (DE)

( * ) Notice: Subject to any disclaimer, the term of this patent is extended or adjusted under 35 U.S.C. 154(b) by 100 days.

(21) Appl. No.: 13/497,045

(22) PCT Filed: Sep. 21, 2010

(86) PCT No.: PCT/EP2010/063916

§ 371 (c)(1),
(2), (4) Date: May 30, 2012

(87) PCT Pub. No.: WO2011/033128

PCT Pub. Date: Mar. 24, 2011

(65) Prior Publication Data

US 2012/0231677 A1 Sep. 13, 2012

(30) Foreign Application Priority Data

Sep. 21, 2009 (DE) ..... 10 2009 042 385

(51) Int. Cl.
*H01R 12/00* (2006.01)
*H01R 12/58* (2011.01)
*H01R 4/18* (2006.01)

(52) U.S. Cl.
CPC ..... *H01R 12/585* (2013.01); *H01R 4/184* (2013.01); *Y10T 29/49124* (2015.01)

(58) Field of Classification Search
USPC ..... 439/78, 744, 82, 825, 751, 871
See application file for complete search history.

(56) References Cited

U.S. PATENT DOCUMENTS

| | | | | |
|---|---|---|---|---|
| 2,755,453 | A | 7/1956 | Cloutier | |
| 3,963,316 | A | 6/1976 | Williams | |
| 4,526,429 | A * | 7/1985 | Kirkman | 439/82 |
| 4,676,579 | A * | 6/1987 | Ting | 439/825 |
| 4,946,408 | A | 8/1990 | Garrett et al. | |
| 5,004,438 | A * | 4/1991 | Cabourne | 439/825 |
| 5,209,680 | A * | 5/1993 | Fry | 439/825 |
| 5,427,546 | A * | 6/1995 | Garritano et al. | 439/502 |
| 5,669,792 | A | 9/1997 | Naka et al. | |
| 5,910,031 | A | 6/1999 | Goto | |

(Continued)

FOREIGN PATENT DOCUMENTS

| | | | |
|---|---|---|---|
| CN | 1106581 | A | 8/1995 |
| DE | 19752210 | A1 | 5/1999 |

(Continued)

*Primary Examiner* — Hien Vu
(74) *Attorney, Agent, or Firm* — Robert A. Blaha; Smith Tempel Blaha LLC

(57) ABSTRACT

The invention relates to a connector device for electrically connecting a conductor to a circuit board by means of the direct insertion of the connector device into a contact hole of the circuit board. The connector device comprises a fastening region for fastening the conductor to the connector device, a transfer region for transferring a current from the conductor to the circuit board and at least three insertion elements that can be inserted into the contact hole together. Each of the insertion elements extends from a common base body of the connector device and runs separately from the other insertion elements. The insertion elements can be elastically deformed independently of one another in relation to the base body and are configured such that when the insertion elements are inserted in the contact hole, a plug connection of the connector device to the circuit board can be provided.

17 Claims, 5 Drawing Sheets

(56) References Cited

U.S. PATENT DOCUMENTS

| | | | | |
|---|---|---|---|---|
| 6,000,973 | A * | 12/1999 | Mitra | 439/825 |
| 6,168,441 | B1 * | 1/2001 | Buchart | 439/82 |
| 7,780,489 | B2 * | 8/2010 | Stuklek | 439/825 |
| 8,075,322 | B2 * | 12/2011 | Schwettmann et al. | 439/82 |
| 2003/0124886 | A1 * | 7/2003 | Reisdorf et al. | 439/82 |

FOREIGN PATENT DOCUMENTS

| | | | |
|---|---|---|---|
| DE | 19752201 | A1 | 7/1999 |
| EP | 1069651 | A1 | 1/2001 |
| EP | 1791215 | A2 | 5/2007 |
| FR | 2192439 | | 8/1974 |

* cited by examiner

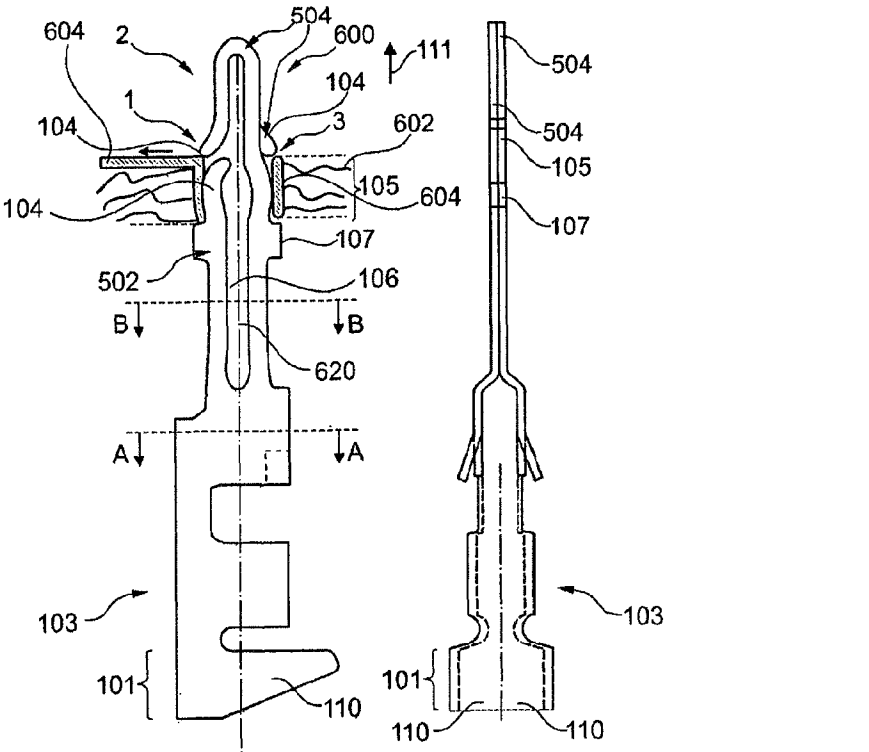
Fig. 6
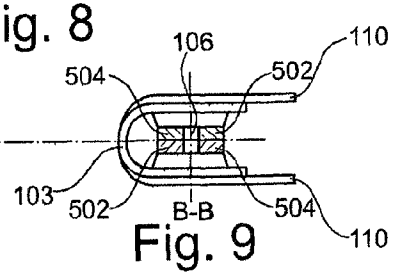
Fig. 8
Fig. 9
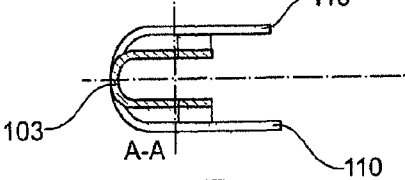
Fig. 7
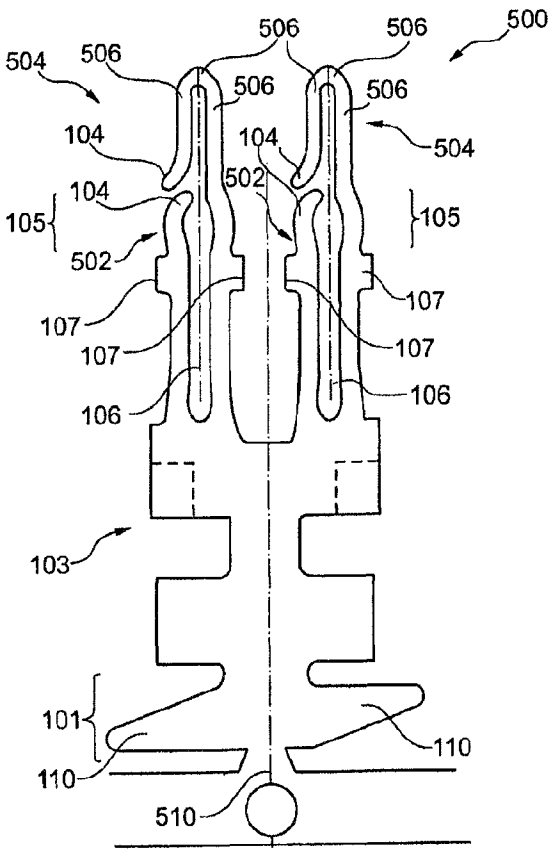
Fig. 5

MULTI-FORK PRESS-IN PIN

TECHNICAL FIELD

The present invention relates to a connector device for electrically connecting a conductor to a circuit board by directly inserting the connector device into a contact hole in the circuit board. The present invention further relates to a connection arrangement with the connector device and the circuit board. The invention further relates to a connector arrangement. In addition, the invention provides a semi-finished connector made from a foldable material, which can be used to produce the connector device. Moreover, the present invention relates to a method for electrically connecting a conductor to a circuit board by directly inserting a connector device into a contact hole in the circuit board. In addition, the present invention relates to a vehicle with the connector device.

BACKGROUND

IPC class H01R 13/53 relates to base plates or cases made for high electrical requirements. IPC class H01R 13/533 relates to base plates or cases made for use in extreme conditions, e.g. high temperature, radiation, vibration, corrosive environment, pressure.

For the manufacture of electrical and/or electronic connections between different components, conductors or the like, plug connections are known in the art, said connections comprising a plug element and a socket element. For example, there are normal sockets into which plugs can be inserted, which are fitted to the end of lines. Connection arrangements of this kind are also suitable and intended for connections that are made and broken very frequently.

In the case of relays, cut-outs or the like, it is likewise known to attach a base to a unit, into which the cut-out or relay can be inserted. Here, too, replacement should be possible, although replacements are less common in this case than with the connection processes between socket and plug.

Even where connection processes between circuit boards and plug elements are involved, it is customary for a base or plug socket to be disposed on the circuit board or even at another point and for the socket then to be connected to the circuit board with the help of conductors.

EP 1 069 651 A1 discloses a metal terminal, which is inserted into a contact hole in an electrical circuit substrate and makes an electrical contact at the contact hole. The terminal has a stop member, which abuts the substrate at the rear end of the contact hole, thereby preventing further insertion of the terminal into the contact hole. A removal prevention portion abuts the substrate at the front end of the contact hole to resist an accidental withdrawal of the terminal. The removal prevention portion is resiliently deformable to allow it to pass through the contact hole during insertion of the terminal. Contact elements between the stop member and the removal prevention portion make electrical contact in the contact hole.

However, investigations into the kind of such a metal terminal described have revealed that the removal prevention portion, descriptively formed as a ring, is readily prone to plastic deformation when inserted through the contact hole and is therefore frequently destroyed. In other words, the passage of this wide removal prevention portion through a narrow contact hole and the requirement for a sufficiently high holding force to be generated by the removal prevention portion represent an insurmountable technical contradiction with the system described in EP 1 069 651 A1.

Moreover, the terminal disclosed in EP 1 069 651 A1 is hard for a user to handle. Passing the removal prevention portion through the contact hole requires the application of a very large manual force if an adequately high holding force is then to be achieved in the introduced state, something that quickly overburdens a human operator, particularly when several contacts are to be made at the same time. In addition, the mechanical load acting on the board in accordance with EP 1 069 651 A1 is great. Also, simple insertion along the lines of a socket-plug approach is not possible with a system of this kind, as high holding forces lead to plastic deformation of the removal prevention portion.

U.S. Pat. No. 2,755,453 discloses an electrical connector that can be passed through a hole in an electronic terminal. Sections at the end of the connector and at the opposite side of the connector may be curved, in order to achieve a mechanical fixing in the electrical terminal.

SUMMARY

The need being addressed by the invention is that of achieving an improved plug connection between a circuit board and a connector device.

This need is met by a connector device for electrically connecting a conductor to a circuit board by directly inserting the connector device into a contact hole in the in the circuit board, by a connector arrangement, by a semi-finished connector made from a foldable material, by a connection arrangement, by a method for electrically connecting a conductor to a circuit board by directly inserting a connector device into a contact hole in the circuit board and by a vehicle with the connector device in accordance with the independent claims.

In accordance with an exemplary embodiment of a first aspect of the invention, a connector device is described for electrically connecting a conductor to a circuit board by directly inserting the connector device into a contact hole in the circuit board. The connector device comprises a fastening region for fastening the conductor to the connector device. In addition, the connector device comprises a transfer region for transferring a current from the conductor to the circuit board. Furthermore, the connector device comprises at least three insertion elements which can be jointly inserted into the contact hole. Each of the insertion elements extends from a common base body of the connector device and runs separately from the other insertion elements. The insertion elements are elastically deformable independently of one another in relation to the base body and are configured such that when the insertion elements are inserted into the contact hole, a plug connection of the connector device to the circuit board can be provided. All further features are optional.

In accordance with another exemplary embodiment, a connector arrangement is provided which comprises a connector device with the features described above and a form tool, wherein the form tool is configured to actuate the connector device locked to the circuit board in such a manner that the connector device locked to the circuit board can be unlocked.

In accordance with an exemplary embodiment of a further aspect of the invention, a connection arrangement with the connector device referred to above and the circuit board is described. In accordance with the connection arrangement, the connector device is connected to the circuit board by means of a plug connection.

In accordance with a further aspect of an exemplary embodiment of the present invention, a method is provided for electrically connecting a conductor to a circuit board by directly inserting a connector device into a contact hole in the circuit board. In accordance with the method, the conductor is secured to a fastening region of the connector device. At least three insertion elements of the connector device are jointly inserted into the contact hole. When the insertion elements are inserted into the contact hole, a plug connection is provided between the connector device and the circuit board because of an independent elastic deformation of the insertion elements in relation to the base body. A current is transferred from the conductor to the circuit board via a transfer region of the connector device. All other features are optional.

In accordance with a further exemplary embodiment of the invention, a vehicle is described which is provided with a connector device or a connection arrangement with the features described above.

By means of the connector device depicted, a conductor may in particular be (detachably) secured to the circuit board by means of direct insertion into a contact hole in said circuit board. The contact hole in the circuit board may be plated-through and can comprise an electrically conductive coating, for example, so that a current transfer can be provided in this region. With direct insertion of the connector device into the contact hole of the circuit board, a so-called direct connection technique may be used, in which no sockets or other auxiliary devices have to be fitted between the connector device and the circuit board. In this way, the connector device may produce simplified assembly protection by means of the use of the direct connection technique, as there is only a two-dimensional coating requirement.

The circuit board may be essentially flat and only exhibit contact holes and the contact surface thereof. If necessary, flat soldered components may be present on this. In other words, it is also possible to use a direct connection technology to save on a complete case (and the necessary tools), in that the assemblies are encapsulated respectively coated and are therefore completely protected either mechanically or chemically. While elaborate masking of three-dimensional components, such as sockets, for example, is traditionally necessary before the sealing or painting of a 3D surface or an elaborate selective coating process, according to the invention a simple mask could be used to cover the area of the contact hole bore and the contacts contained therein and an entire remaining surface section of the conductor path sprayed with paint or sealed. A corresponding method for forming an assembly protection is provided in accordance with the invention.

The connector device may be directly inserted into the (through-plated) contact hole in the circuit board, as described above. In this case, the at least three insertion elements are jointly inserted into the contact hole. The insertion elements extend from a common base body of the connector device, particularly in the direction of the contact hole. The insertion elements consist of plug-in bars or plug-in pins, for example, and may for example be characterised in that each insertion element has an extremely small diameter by comparison with its length. In addition, the insertion elements and, for example, the entire connector device may be made from materials which are suitable for elastic deformation, such as certain metals or plastics, for example, wherein materials capable of plastic deformation should not be used.

The connector device is connected to the circuit board in a plug-in direction or insertion direction, wherein the insertion elements are particularly inserted into the contact hole in the plug-in direction or insertion direction. The insertion direction is essentially defined parallel to the extension direction of the contact hole. In addition, the insertion direction may be defined as the direction that is perpendicular to a surface normal of the internal surface of the contact hole or is also perpendicular to a plane of the surface of the circuit board.

The insertion elements are inserted into the contact hole in the insertion direction. In this case, the insertion elements are elastically or flexibly deformable in relation to the base body, so that the insertion elements can deform elastically transversely or perpendicular to the insertion direction.

The term "elastically deformable" refers in particular to an insertion element or a material of an insertion element, which undergoes a functionally significant change in form due to the action of an external force, said change being reversed when the external force is removed, so that the elastically deformable material returns to its original form (initial form). An elastically deformable material may be free or largely free from plastic deformation or machining deformation until a particular force is applied. The modulus of elasticity that describes the relationship between stress and strain in the deformation of a solid body with linear elastic behaviour, may be smaller than 1 $kN/mm^2$, particularly smaller than 0.5 $kN/mm^2$, more particularly smaller than 0.1 $kN/mm^2$, in the case of elastically deformable material. For example, the modulus of elasticity in the elastically deformable material (for example, rubber, elastomers) may be between 0.01 $kN/mm^2$ and 0.1 $kN/mm^2$. These values for the modulus of elasticity may relate to a temperature of 20° C. An "elastically deformable material" may in particular denote a material with a hardness according to ISO 868-2003 (DIN 53505) of 20 to 110 Shore A, particularly of 30 to 90 Shore A, further particularly of 40 to 70 Shore A. For example, the elastically deformable material may exhibit a Shore hardness within the range 90±5 Shore A to 30±5 Shore A.

Using the elastic deformability of the insertion elements, these may be pressed together, for example, during insertion into the contact hole. Following the insertion or introduction of the insertion elements into the contact hole, the elastically deformed insertion elements try to return to their initial position and are prevented from doing so by the internal wall of the contact hole. The force acting to return each elastically deformable insertion element to its initial position is transferred to the circuit board by the insertion element lying adjacent to the internal surface of the contact hole. This produces a force that leads to high friction and compression and provides the plug connection (e.g. interference fit) between the insertion elements and the contact hole or the entire connector device and the circuit board.

The extension direction of an insertion element may be understood as to be the direction in which the insertion element extends from the base body. This means that at least two of the three insertion elements do not extend parallel to one another, but at an angle, particularly between 0 and 90° C. to one another. The insertion elements may be splayed out from one another in their extension direction or may not run parallel to the extension direction. When inserting the insertion elements into the contact hole, said elements may be pressed together and inserted into said contact hole. By pressing together the insertion elements, they have a combined diameter that is smaller than the contact hole, so that the insertion elements can be inserted. By requiring the insertion elements to recover their initial position, the pressing force is provided to supply the plug connection.

The insertion elements may be capable of being inserted into the contact hole elastically and reversibly and, for example, with forces of maximum 10 Newton. A reliable plug connection can thereby be achieved with the internal surface of the contact hole and good handling properties can be realized. For example, the connector device or connection arrangement according to the invention is suitable for vehicle applications in tractors or buses, for example, in which according to the invention a mechanical fastening of the connector or plug and the circuit board is facilitated. Connections of this kind can transfer strong currents and withstand high mechanical loads. At the same time, they can be plugged in by hand many times. Consequently, high holding forces can be achieved with low insertion and removal forces, for cases where a tractor has to be repaired by a user on the land, for example.

When the connector device is in the installed state in the contact hole, the insertion elements are elastically deformed and stressed, so to speak. The term "stressed" means that the insertion elements are (elastically) deformed in one direction by the internal surfaces of the contact hole and are subject to a restoring force in the opposing direction. From this stressed, elastically deformed position, the insertion elements try to spring back into their initial position and generate compressive force, frictional force or pressing force through the pressing of the insertion elements against the side wall of the contact hole, said forces producing the plug connection. The stressed position or elastically deformed position can therefore be taken to mean that the insertion elements are not in a natural, non-deformed initial position, but in an elastically deformed position. Due to the elastically deformed, stressed position and the resulting impulse for the insertion element to return to its initial position, the elastic or pressing force is created between the insertion element and the internal surface of the contact hole, so that a holding connection or interference fit is produced between the connector device and the circuit board.

In particular, the connector device according to the invention comprises at least three insertion elements, which can be inserted into the contact hole. Where the number of insertion elements is three or higher, an improved attachment and current transfer is provided between the connector device and the circuit board. Where there are at least three insertion elements which can move particularly independently of one another, it is guaranteed that at least two insertion elements splay out in the contact hole and provide a plug connection (e.g. interference fit). When only two insertion elements are used, particularly where contact holes are formed in an unclean manner (e.g. out of round and with edges), this may result in only one insertion element abutting against the internal surface of the contact hole, so that a stable plug connection between the connector device and the circuit board cannot be provided and the connector device is movable or waggles against the circuit board. In particular vibrations affecting the circuit board may cause the insertion element to become inadvertently detached from the circuit board. By means of the addition of at least one further third insertion element, the probability that at least two insertion elements will splay out in the contact hole increases, even if the contact holes are formed in an unclean manner, so that a safe, durable plug connection can be provided. This leads to an improvement in the quality of a connector device and a reduction in fault susceptibility, for example a reduction in the risk that the connector device will become automatically detached from the circuit board.

The plug connection may be provided by means of a crimp connection or an interference fit, for example, wherein the crimp connection or interference fit may be strongly formed by means of the insertion elements, so that a vibration-robust mechanical safeguard is provided. In addition, the plug connection may be provided and set by the degree of elastic deformation of the insertion elements and/or by the restoring forces of the insertion elements.

The term "vibration-robust mechanical safeguard" may mean, in particular, that even in the presence of vibrations which act on a technical system comprising the connector device respectively the connector arrangement, an inadvertent detachment of the connector device from the circuit board is avoided. In particular the kinds of vibrations that occur in an engine-powered, particularly a combustion engine-powered device (particularly a vehicle), do not have a negative effect on system function where there is a vibration-robust mechanical plug connection or interference fit. Particularly when the insertion device or connection arrangement is installed in the engine space of an off-road vehicle, the vibrations that normally occur there should not result in an unwanted loss of electrical contact between the insertion device and the counter contact in the contact hole of the circuit board assigned in each case. Consequently, in order to achieve vibration robustness, the mechanical plug connection may be designed through the insertion elements, particularly with regard to the material, dimensions, securing forces of the insertion elements, etc., such that the corresponding vibrations do not lead to an unwanted detachment of the connector device from the circuit board. The connector device and particularly the insertion elements thereof may be designed to achieve vibration robustness in conjunction with industrial standard ISO TS 16750, particularly ISO TS 16750-3. ISO 16750 defines a standard for mechanical load requirements for off-road vehicles. In order to achieve vibration robustness, the connection configuration may also be designed to conform to IEC 60512-4, particularly at least one of the secondary requirements under IEC 68.2.6 (vibration sinusoidal), IEC 68-2-27 and IEC 68-2-29 (multiple shocking), IEC 68-2-64 (broadband noise), IEC 68-2-64 (vibration in cold atmosphere) and IEC-68-2-50 and IEC-68-2-51 (vibration in warm atmosphere).

In accordance with a further exemplary embodiment, each of the insertion elements exhibits an insertion section. The insertion section is the section located within the contact hole when the insertion elements are inserted into the contact hole. The insertion elements jointly extend from a base body of the connector device separately from the other insertion elements, so that each of the insertion elements exhibits a free end.

The end section comprised by each of the insertion elements may, for example, extend via the insertion section of the insertion element, so that the end section projects out of the contact hole with the free end of the insertion element when the connector device is in the inserted state in the contact hole on the opposite side of the base body relative to the circuit board. In other words, the end portion or the free end of the insertion element may project out of the contact hole in the plug-in direction if the connector device is inserted with the insertion elements in the contact hole.

In addition, each insertion element may exhibit an intermediate section between the insertion section and the base body. By means of the intermediate section, in an exemplary embodiment of the invention, the base body may not be located directly onto a surface of the circuit board, so that the insertion elements initially display the intermediate section in the plug-in direction. Adjacent to the intermediate section in the plug-in direction there extends the insertion section of the insertion element extends, which insertion section is terminated for instance by means of the end section of the insertion element.

In accordance with a further exemplary embodiment, the insertion section comprises the transfer region at least in part. This means that the current or power transfer between the conductor via the connector device to the circuit board via a contact of the insertion section is provided with the internal surface of the (through-plated) contact hole. The insertion section of the insertion element may be coated with a conductive layer, for example. In addition, the insertion elements or also the entire connector device may be made from a conductive material, in which case regions that are not intended to transfer current, in particular, can then be coated with an insulating layer. Since the insertion section is already in contact with the internal surface of the contact hole, due to the creation of the plug connection or the interference fit, the transfer region may be simultaneously provided without further structural design, so that by means of a simple construction a mechanical fitting and electrical conductivity of the connector device is provided simultaneously by the at least three insertion elements.

In accordance with a further exemplary embodiment, the insertion section of each insertion element comprises at least one convex surface. The convex surface is particularly formed on the side of the insertion elements, which is aligned towards the internal surface of the contact hole when the insertion elements are inserted. The convex design of a surface of the insertion sections may reduce the contact area between the insertion element and the internal surface of the contact hole. The force (pressing force, elastic force) can thereby be concentrated on a smaller region, namely on the region which is in contact with the internal surface of the contact hole due to the convex curvature. The concentration of the contact region increases the bearing pressure. The bearing pressure is defined as the force per contact area between two solid bodies. The increase in bearing pressure may bring about an improvement in the interference fit between the connector device and the circuit board. In other words, the convex surface produces a greater bearing pressure, so that a more stable interference fit can be provided and a more stable contact in addition and also more stable conductivity between the connector device and the circuit board.

In accordance with a further exemplary embodiment, at least two of the three insertion elements fit closely against one another, at least in part. The close fitting of two insertion elements means that they support and stabilise one another, so that a greater mechanical load capacity can be provided. Despite the close fitting of two insertion elements, these may nevertheless be freely movable in the further directions and splay out at different points in the contact hole.

In accordance with a further exemplary embodiment, at least two insertion elements are spaced from one another by a gap. The insertion elements which are separated by a gap may become elastically deformed in the direction of the gap. This means that the insertion elements may become elastically deformed during introduction into the contact hole in the direction of the gap, so that the connector device can be inserted into the contact hole by means of the insertion elements.

The insertion elements, so to say, form arms, leaving an intermediate space free. Their outer faces turned away from one another may optionally have a convex curve, for example. A curve of this kind means that unwanted splaying of the arms when in contact with a flat surface can be avoided. When using fork contacts, an elastic plugability can be achieved.

In accordance with a further exemplary embodiment, the base body comprises a limit stop section. The limit stop section is arranged such that an insertion of the insertion elements into the contact hole can be restricted by the limit stop section. The limit stop section prevents further introduction of the connector device in the plug-in direction, for example. The limit stop section may be created by a convexity or projection in the base body, for example, so that the base body with the limit stop section comprises a greater diameter than the contact hole, for example. Consequently, the cross-section with the limit stop section cannot be passed through the contact hole, so that a limit stop can be automatically provided. The limit stop section may also be formed on at least one insertion element, particularly in the intermediate region or intermediate section of the insertion element. This means that it is not necessary that the base body fits closely against a surface of the circuit board, but only the limit stop section of one of the insertion elements. As a positioning aid, this sort of limit stop section may make the insertion in between the insertion element and the circuit board in a correct manner intuitively easier for the user and thereby avoid electrical malfunctions. The limit stop section thereby serves to limit the insertion of the connector device into the circuit board. The limit stop section or spacer may define a minimum interval between the circuit board and the connector device and thereby prevent the formation of unwanted electrical contacts or the jumping of an electrical signal over a narrow gap, for example.

In accordance with a further exemplary embodiment, the insertion elements extend parallel to one another.

The elastic deformability of the insertion elements may be achieved by at least two of the three insertion elements comprising a gap between one another, wherein these insertion elements may deform elastically in the direction of the gap. A restoring force acting against the gap direction may then cause the insertion elements to be pressed against an internal surface of the contact hole, so that an interference fit can be provided.

In accordance with a further exemplary embodiment, each of the insertion elements comprises an extension direction, wherein the distance between at least two insertion elements along their extension directions is inconstant.

In accordance with a further exemplary embodiment, the end of each insertion element comprises a rounded surface. By contrast with a bevelled end surface, wedging of each insertion element when inserted into the contact hole is prevented by the rounded end surface, as a rounded surface is able to find its way into the contact hole in a self-guiding manner, for example.

In accordance with a further exemplary embodiment, at least one insertion element comprises a widening at one end portion. The end portion comprises the free end of the insertion element in this case and projects from the contact hole in the plug-in direction, when the insertion element is inserted into the contact hole. The widening is formed in such a way at the end section that said widening becomes wedge or jammed with a surface of the circuit board when the insertion element is inserted in the contact hole. The widening may be in the form of an elevation and may form an undercut, which extends essentially perpendicular to the plug-in direction. In other words, the widening (undercut) may extend parallel to the surface plane of the circuit board and therefore may be essentially perpendicular to the internal surface of the contact hole. It is thereby possible for the widening to prevent the connector device from moving against the plug-in direction, in that the widening fits closely against a surface of the circuit board and thereby prevents further movement of the insertion element against the plug-in direction. The insertion elements may be pressed together, for example, during an insertion into the contact hole, so that the cross-section of all insertion elements, including the widening, comprises a smaller diameter than the contact hole. When the insertion elements are introduced into the contact hole, said insertion elements move back into their initial position on account of their elastic deformability, so that the interference fit between the insertion elements and the contact hole can be formed. With the connector device in an inserted state in the contact hole, the base body or particularly the ledge usually fits closely against a surface side of the circuit board of the base body. On the opposite surface of the circuit board, the insertion elements may project with their end portions out of the contact hole. The widening which becomes wedged or jammed with this surface of the circuit board is formed in these end portions, so that a detachment of the connector device against the plug-in direction is thereby prevented. Wedging or jamming may occur if a cross-section of the insertion elements including the widening is greater than the diameter of the contact hole, so that a detachment of the plug connection is thereby prevented. The mechanical connection between the connector device and the circuit board is thereby prevented. The wedging or jamming of the widening with the circuit board can be released through the elastic deformability of the insertion elements. If the connector device is to be detached from the circuit board, for example, the insertion elements may be pressed together again essentially perpendicular to the plug-in direction, so that the diameter of the insertion elements including their widenings is smaller than the contact hole. The connector device can thereby be detached from the circuit board by pulling the insertion elements out of the contact hole against the plug-in direction.

In accordance with a further exemplary embodiment of the present invention, the widening comprises a first surface. The first surface overlies the surface of the circuit board, when the insertion element is inserted into the contact hole. The first surface is formed in such a manner that an oblique angle is produced between the plane of the first surface and the plane of the surface of the circuit board when the insertion element is inserted into the contact hole.

"Oblique angle" means that between the plane of the first surface and the plane of the circuit board surface, an angle of between 0° (degrees) and 90°, particularly between 1° and 89°, and more particularly between 20° and 60° is formed. In other words, a wedge-shaped, oblique plane is formed with the first surface. The first surface forms an oblique wedge surface at the recess, for example, so that an undercut is formed. The first surface of the widening runs outwardly along the extension direction, e.g. radially outwardly relative to a mid-point of the contact hole. In other words, the widening forms a wedge, wherein the wedge may exhibit a wedge tip and a base area opposite, wherein the base area and the wedge tip are connected by means of the first surface. The wedge tip is directed towards the contact hole and the base surface is directed away from the contact hole in the plug-in direction, when the insertion element is inserted into the contact hole.

If the connector device is moved against the plug-in direction, a force is transferred from the circuit board via a contact point between the circuit board and widening to the oblique, first surface, which leads to an elastic deformation of the insertion element towards the mid-point of the contact hole. The deformation of an insertion element with the wedging surface depends firstly on the tensile force with which the connector device is pulled against the plug-in direction. In addition, the elastic deformation of the insertion elements through the first surface depends on the material properties, for example the modulus of elasticity, the connector device and the insertion elements. By adjusting the angle of the first surface, a force may be defined or adjusted, which results in the widening (undercut) being removed from the wedge position or jamming position. A flat first surface with an angle to the plane of the circuit board surface of essentially 1° to 10° (degrees), so that for example the plane of the first surface is formed virtually parallel to the internal surface of the contact hole or perpendicular to a plane of the circuit board surface, results in a lesser force being necessary in order to release the insertion element from the wedging. A sharper angle, in other words, an angle in which the wedge surface is virtually perpendicular to the internal surface of the contact hole or virtually parallel to the plane of the circuit board surface, produces a greater force, which is necessary in order to remove the insertion element from the contact hole.

In accordance with a further exemplary embodiment, the conductor is secured to the fastening region by means of a clamped connection. The clamped connection may be provided, for example, in that the connector device exhibits two clamping straps, which may be bent around the conductor, in order to transfer a clamping force to the conductor and to secure the latter. The clamping straps may be plastically deformable, for example. In particular, the fastening region is designed in such a manner that the conductor can be clamped there by means of a clamped connection according to EN 60352-2 or according to DIN 41611.

In accordance with a further exemplary embodiment, the insertion elements are designed in such a manner that the connector device and the circuit board can be connected by means of the plug connection with a mechanical loading capacity in accordance with ISO 16750, particularly in accordance with ISO 16750-3.

In accordance with a further exemplary embodiment, the insertion elements are formed to connect (together) the connector device and the circuit board with a mechanical attachment force (e.g. produced by interference fit and widening) of at least 100 N (Newton), particularly of at least 200 N, more particularly of at least 300 N.

In accordance with a further exemplary embodiment, each of the insertion elements is designed for an insertion into one of the contact holes with an insertion force of maximum 10 N (Newton). In particular, all insertion elements may be designed for insertion into a contact hole in the plug-in direction along with a combined total insertion force of maximum 10 N.

In accordance with a further exemplary embodiment, the insertion elements are designed to provide an electrical loading capacity in accordance with ISO 16750-2.

In order for the applicability of the connector device according to the invention to be harnessed, particularly for automotive applications susceptible to vibrations and with high energy needs and the like, in addition or as an alternative to fulfilment of the aforementioned industrial standards, the connector device or the connection arrangement may also be designed so that it is compatible with IEC-60512-6 (rapid temperature cycles under force-fitting standard), particularly also in accordance with IEC-68-2-14 (dry heat). It is also possible for the connector device or the connection configuration to be designed in accordance with tests on different climatic conditions according to the force-fitting standard IEC-60512-6 and IEC-60512-11-1 (cf. in particular IEC 68-2-1 (coldness), IEC 68-2-2 (dry heat) and IEC 68-2-30 (damp heat, cyclic)). The connector device or the connection arrangement may also be designed in accordance with an industrial atmosphere test compliant with IEC 60512-11-7 (IEC 68-2-52 (salt spray, cyclic) and IEC 68-2-60 (corrosive gas ($H_2S$, $NO_2$, $SO_2$).

In accordance with a further exemplary embodiment, each of the insertion elements and the transfer region of the connector device are designed for an electrical load capacity of at least 5 amperes, particularly of at least 10 amperes, more particularly of at least 20 amperes. The connector device, particularly the transfer region and the insertion elements, therefore have a high current capability.

The term "high current capability" may mean in particular that the connector device, particularly the transfer region and the insertion elements, are designed in terms of their dimensions, material, spacing from one another, etc., such that they are suitable for carrying a high electric current. In other words, an electric current in the ampere range may be transferred from the transfer region to the conductor paths when using a connector device with a high current capability. A high current is referred to in particular when the connector device is particularly designed to be able to transport at least 5 amperes in the transfer region, particularly at least 10 amperes in the transfer region, without jeopardising proper use of the connector device. In other words, the connector device in a high current configuration should be designed such a manner that an unwanted temperature rise in said connector device is avoided or another technical function of the connector device suffers damage if such high currents are conducted by means of the contact elements. In particular, the high current-resistant design of the connector device may be such that the transfer region, particularly all insertion elements combined, are able to carry cumulative currents of at least 50 amperes, particularly of at least 100 amperes. The high current capability of the connector device may be considered to exist if the connector device can be connected to a vehicle battery and can supply current from the vehicle battery to the connected circuit board without interruption. In particular, the high current capability may be considered to exist if transitional resistances satisfy the requirements of IEC 60512-2 according to the press-fit standard.

In accordance with a further exemplary embodiment, the connector device comprises at least three further insertion elements. The at least three insertion elements form a first group, which can be jointly inserted into the contact hole. The at least three further insertion elements form a second group, which can be jointly inserted into a further contact hole in the circuit board. The additional insertion elements may exhibit the same physical properties as the insertion elements described above and, in addition, extend from the same base body of the connector device. It is thereby possible to provide a connection with a multiplicity of contact holes with a connector device. In particular, it is possible for additional conductors to be attached to the connector device, wherein the first group of insertion elements is assigned electro-conductively to a first conductor and the further insertion elements belonging to the second group can be assigned electric-conductively to a second conductor. The first conductor and the second conductor may form separate circuits and transmit different signals, for example. A multi-pin plug, for example, can thereby be provided.

In accordance with an exemplary embodiment, the connector device may be formed from a single punched and curved electrically conductive board. In this embodiment the connector device can be formed at very low manufacturing cost, as no components are needed apart from a metal plate or similar.

In accordance with an exemplary embodiment, the connector device may comprise two pairs of insertion elements, in other words at least four insertion elements. In other words, at least four, particularly precisely four, insertion elements may be provided. Each pair of insertion elements may be identically formed. Two insertion elements of each respective pair may be disposed starting from the base body right next to one another, only spaced apart by a gap. Two insertion elements of a pair may be structurally different and interact with one another. The pairs may also be identical in design, though.

In accordance with an exemplary embodiment, the insertion elements of one of the pairs may be fully in contact with the insertion elements of the other of the pairs. In other words, a main surface of an insertion element may cover a complete corresponding main surface equal in area of the other insertion element contiguously and vice versa. A compact and at the same time extremely stable structure is created at the same time, which can also be reliably and precisely inserted into a contact hole.

In accordance with an exemplary embodiment, at least one of the insertion elements may exhibit a locking mechanism, which is set up to lock the connector device onto the circuit board when said connector device is passed through the contact hole. In other words, it may be sufficient to pass the connector device through the contact hole in the circuit board, whereby the locking mechanism on one or more of the insertion elements is locked onto the circuit board automatically, i.e. without user involvement. This allows for a high user convenience.

In accordance with an exemplary embodiment, the locking mechanism may be configured so that when the insertion elements are pressed together and the connector device is pulled out of the contact hole, the connector device is unlocked from the circuit board. Consequently, a simple unlocking process can be facilitated by reversing the process involved in locking, in other words, pressing together the insertion elements and then removing the connector device from the circuit board. This sort of locking mechanism may comprise reversible characteristics, i.e. it may essentially be locked and unlocked any number of times. This may be due to locking and unlocking characteristics that set aside plastic deformation of the insertion elements and instead elastically deform the insertion elements during locking and unlocking.

In accordance with an exemplary embodiment, a first of the insertion elements may comprise or consist of an insertion section, which is located within the contact hole when the insertion elements are inserted into the contact hole. A second of the insertion elements may comprise an insertion section, which is located within the contact hole when the insertion elements are inserted into the contact hole, and it may comprise a curved section, which extends from the insertion section through the contact hole back as far as the insertion section of the first of the insertion elements and is separated from this by a gap. The size of the gap may be made smaller initially during the insertion process of the connector device into the circuit board and then made larger again once the curved section has emerged from the circuit board. The first and second insertion element may form an interacting pair. Due to the curved section, any catching of the connector device may be avoided during an insertion into the circuit board. In addition, the combination of the two insertion elements guarantees both reversible locking and also rigid anchoring of the connector device in a contact hole of a circuit board.

In accordance with an exemplary embodiment, an end region of the curved section may be capable of being passed through the contact hole resiliently when inserted into the circuit board and it may spring back after being passed through the contact hole, whereupon the connector device can be locked to the circuit board by means of the end region. While the curved section is passed through the contact hole, it is compressed inwardly by a lateral limit of the contact hole. After emerging from the circuit board, this compressive force subsides, so that the curved section can spring back outwardly and a locking is thereby guaranteed.

In accordance with an exemplary embodiment, a concave region of the curved section may be adjacent to a convex region of the insertion section of the first of the insertion elements. The first insertion element may be in the form of a convex curve. A corresponding concave region of the curved section is disposed in relation to the convex first insertion section, so that they are prevented from catching on one another and are enabled to slide past one another.

The terms "convex" and "concave" refer to outwardly acting surface areas of the connector device, particularly to surface areas of the connector device which face a contact hole wall when the connector device is introduced into a contact hole in the circuit board.

In accordance with an exemplary embodiment, the curved section may comprise two elongated regions being located opposite to one another, which are interconnected by an arced curve, which is located opposite to the insertion sections of the first and second insertion elements. Both elongated regions and the curve connecting these form an essentially U-shape. This facilitates on the one hand the spring action and on the other hand the mechanically stabilising action of the second insertion element. In addition, the curved form prevents the connector device from catching when it is inserted into the contact hole.

In accordance with an exemplary embodiment, a third and a fourth insertion element may be provided in the connector device, one of which may be designed as the first insertion element and another as the second insertion element. The above embodiments of the first and second insertion elements therefore apply in the same way to the third and fourth insertion element.

In accordance with an exemplary embodiment, the second and fourth insertion elements may be located opposite to one another in an axis-symmetrical manner. The axis of symmetry in this case is a longitudinal axis of the connector device, which runs along the gap between the insertion elements.

The second and fourth of the insertion elements may lie against one another in contact. In other words, the second and fourth insertion element may be in contact with one another along a part of its extension, whereby a stabilising effect is associated. At the same time, this contact allows a spring-like compression of the second and fourth insertion element during insertion of the connector device into the circuit board. It is likewise possible for a part of the first insertion element to touch the fourth insertion element and for a part of the second insertion element to touch the third insertion element.

In the embodiments described above, a contact element is created with a fork press and a self-locking function. A corresponding connector device may be used in many technical fields, for example in the automotive industry, in the industrial sector, in the computer industry and also as telecommunications plugs.

With a connector device in accordance with an exemplary embodiment, cut-outs, plug connectors, relays, capacitors, resistors, varistors, etc. may be inserted straight into a circuit board and locked to each contact element by means of a self-locking mechanism. The connection may be detached by means of a simple device or even by hand.

By folding a plate-like contact element in the form of a semi-finished connector, for example, two moveable arms can be obtained, which move outwardly during insertion. A snap-in hook with a spring-loaded property locks into place following correct assembly.

This means that connector interfaces can be saved on and costly secondary locking can be dispensed with. In addition, with low assembly costs, a cost-effective solution is created.

In the case of the connection arrangement, the circuit board may contain the contact hole that is provided with an electrically conductive contact layer. The connector device may make solder-free contact with the circuit board in the contact hole by means of the electrically conductive contact layer. Consequently, a reliable and continuous electrical connection may be achieved through the spring-loaded mounting of the insertion sections on the plating in the contact hole, without requiring a costly solder joint.

In accordance with a further exemplary embodiment, a semi-finished connector made from a foldable plate is provided, which can be used to produce a connector device of the kind described above. To achieve this, the semi-finished connector may be bendable along at least one bending line, so that by bending the semi-finished product the connector device can be produced as described above. Hence, for example, the semi-finished connector may be provided as a thin, sheet-like (layer) material and the bending line formed in its line of symmetry. The bending line may be perforated, for example, in particular the bending line may provide a desired bending point at which the semi-finished connector can preferably undergo plastic deformation in particular. The semi-finished connector may additionally have an outline that exhibits an outline of the connector device. In this case the semi-finished connector may be used in the initial state, so that the conductor is arranged in the fastening region, for example, and is clamped by bending the semi-finished connector along the bending line of the conductors at a defined point in the fastening region. Following the bending of the semi-finished connector, all insertion elements may abut against their predefined point, so that in other words the end product, i.e. the connector device described above, can be provided by folding.

In accordance with a further exemplary embodiment, a connector arrangement is provided in which the form tool is set up to press together the connector device locked to the circuit board, whereby the connector device locked to the circuit board is unlocked. Locking by a barbed hook on the one hand guarantees a secure hold, while on the other hand it can also be detached again. The detachability may be achieved with a corresponding form tool, which is fitted and the barbed hook or hooks are thereby deformed to such an extent that a lock no longer exists.

The semi-finished product or finished connector device may be made as a single piece out of a piece of sheet metal by stamping and bending. This kind or integral design of the insertion element from a piece of sheet metal results in particularly low costs. Alternatively, however, an insertion element may also be formed from several components, in order to integrate further functions, for example.

With the present invention, a connector device is provided which exhibits at least three elastically deformable insertion elements independent of one another, whereby an improved mechanical attachment can be achieved in a contact hole and likewise an improved conductibility between the insertion element and the circuit board can be provided. Particularly in the case of a hole that is not exactly circular, a multiplicity of elastically deformable insertion elements independent of one another leads to an improved abutment of the insertion elements and therefore to an improved mechanical and also electrical attachment or conductivity. An improvement in conductivity leads in turn to an increased current transfer and a smaller transfer resistance between the insertion elements and the contact hole or the circuit board, as it can be guaranteed that at least more than one insertion element can be provided in contact with an internal surface of the contact hole. This also produces the advantage that less accuracy in the shape of the contact holes is needed when producing the circuit board.

By means of the elastic deformation of the insertion elements, it is possible for the plug connection (e.g. the interference fit) to be produced in such a manner that a greater force is required to remove the connector device from the contact hole than to insert it. In addition, the capacity to insert or remove the connector device "by hand" is thereby provided. The capacity to insert or remove the insertion element "by hand" may particularly be understood to mean, within the framework of this description, that the insertion and removal forces are sufficiently small, even when several insertion elements are provided, so that they can be applied by the muscular strength of an average adult user.

The connector device may be inserted manually by a user straight into the corresponding contact holes in the circuit board, without a separate plug-in socket being required between the connector device and the circuit board, as is the case with conventional connection arrangements with a high current capability. At the same time, despite the simple and intuitive insertion of the connector device straight into the circuit board, high vibration robustness can be guaranteed in that a rigid mechanical safeguard is provided by means of the insertion elements, which reliably prevents the inadvertent removal of the connector device from the circuit board in the inserted state, due to high vibrational forces, for example. Because the insertion elements are elastically deformed, insertion and removal by a user is possible with a small amount of force and therefore manually and at the same time the arrangement made up of the connector device and the circuit board can be operated without impeding functioning, even in robust external conditions. Compared with conventional connection arrangements capable of high currents, with a direct plug-in arrangement according to the invention, separate plug-in sockets can be spared, resulting in space-saving and cost advantages and electrical losses or signal distortions are reduced or eliminated on account of a shorter transmission path or the omission of the contact point. Compared with conventional low-current systems, such as in EP 1 069 651 A1, the invention represents a paradigm shift, as the simultaneous fulfilment of high-current-resistant and vibration-resistant requirements is impossible with the architecture there and, in addition, does not allow for manual use with simultaneous contacting of the connector device. On the other hand, according to the invention a direct plug-in technique with high current capability may be achieved for the direct attachment of connector devices to a circuit board without the provision of plug sockets or the like, so that only the circuit board itself is necessary, except for possible optional soldered components and possible purely mechanical attachment elements.

In the transfer region, the connector device may exhibit material with a high current capacity, in order to display adequate electronic conductivity. The transfer region or also the entire connector device may be made in particular from copper, aluminium, silver, gold or alloys, such as brass or bronze. The ohmic resistance in the transfer region may lie between 10 μΩ and 10 mΩ, preferably between 100 μΩ and 1 mΩ. The length of the transfer region through which the electric current flows may be within the 1 mm to 100 mm range, preferably between 2 mm and 50 mm. A thickness of the transfer region through which the electrical current flows may be within the 0.1 to 6 mm range, preferably between 0.5 mm and 3 mm. A cross-sectional area of the transfer region may be within the 0.01 $mm^2$ to 30 $mm^2$ range, preferably between 0.2 $mm^2$ and 25 $mm^2$.

In accordance with an exemplary embodiment of the invention, the vehicle is for example a motor vehicle, a passenger vehicle, a heavy goods vehicle, a bus, an agricultural vehicle, a baling press, a combine harvester, a self-propelled sprayer, a tractor, an aircraft, an airplane, a helicopter, a space ship, an airship, a waterborne craft, a ship, a railway vehicle or a railway, wherein the vehicle exhibits the connector device or the connection arrangement with the features described above.

It should be noted that embodiments of the invention have been described in relation to different objects of the invention. In particular, some embodiments of the invention are described with apparatus claims and other embodiments of the invention with process claims. However, it will be immediately clear to the expert when reading this application, that unless otherwise explicitly stated, in addition to one combination of features belonging to a type of inventive object, any combination of features belonging to different types of inventive objects is also possible.

BRIEF DESCRIPTION OF THE DRAWINGS

Exemplary embodiments are described in greater detail below with reference to the attached drawings, in order to further explain and improve understanding of the present invention. In the figures:

FIG. 5 shows a schematic representation of a semi-finished connector made from a foldable material in accordance with another exemplary embodiment of the present invention;

FIG. 6 shows a schematic representation of a connector device for the electrical connection of a conductor to a circuit board in accordance with an exemplary embodiment of the present invention, wherein the connector device is formed by folding a semi-finished connector;

FIG. 7 shows a cross-sectional view of the connector device according to FIG. 6 along a sectional line A-A;

FIG. 8 shows a side view of the connector device according to FIG. 6;

FIG. 9 shows another cross-sectional view of the connector device according to FIG. 6 along a sectional line B-B.

DESCRIPTION OF EMBODIMENTS

The same or similar components appearing in different figures are labelled using the same reference numbers. The representations in the figures are schematic and are not to scale.

Figure 1:
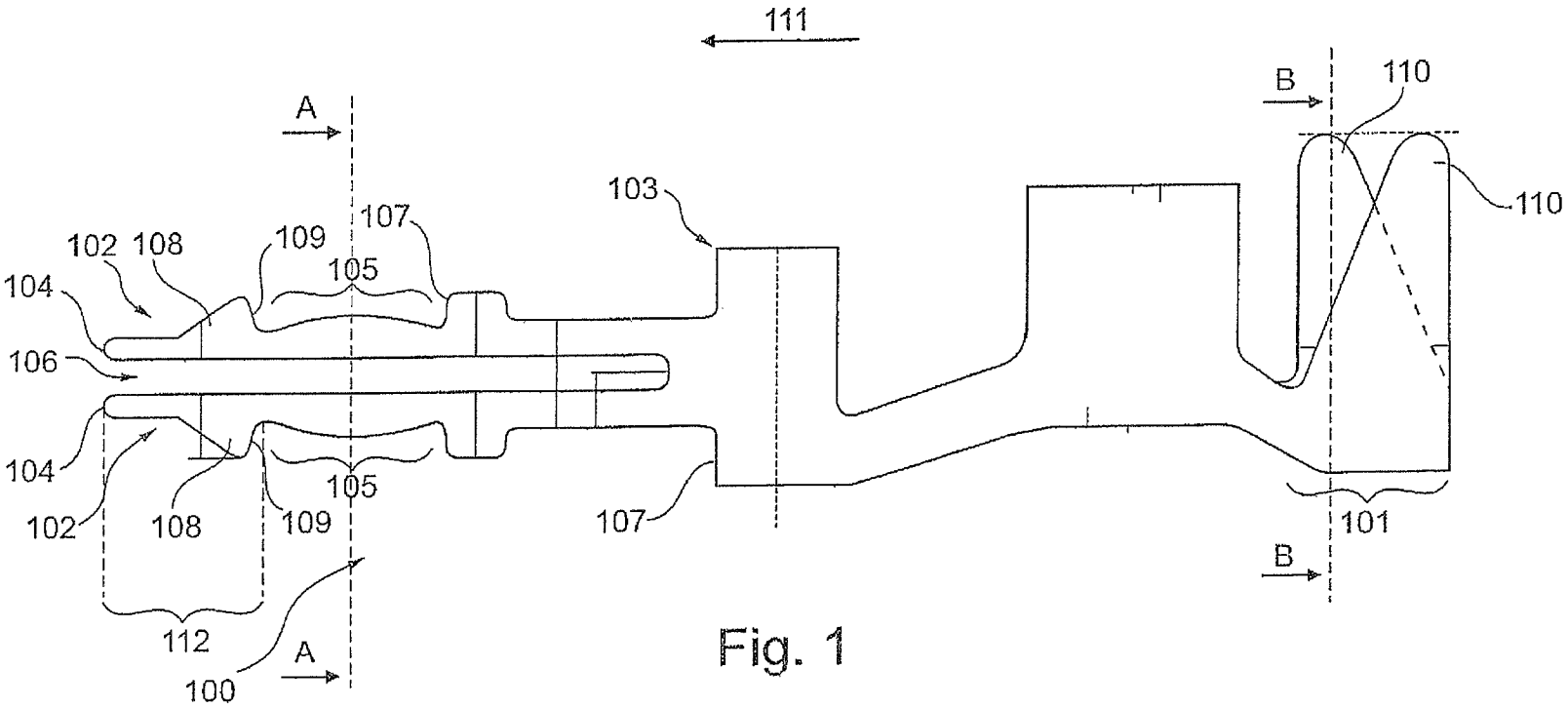
FIG. 1 shows a schematic representation of a connector device for the electrical connection of a conductor to a circuit board in accordance with an exemplary embodiment of the present invention.

FIG. 1 shows an exemplary embodiment of the connector device 100 for electrically connection a conductor 300 (see FIG. 3) to a circuit board by directly inserting the connector device 100 into a contact hole of the circuit board. The connector device 100 comprises a fastening region 101 for securing the conductor 300 to the connector device 100. In addition, the connector device 100 comprises a transfer region for transferring a current from the conductor 300 to the circuit board. Furthermore, the connector device 100 comprises at least three insertion elements 102, which can be jointly inserted into the contact hole. Each of the insertion elements 102 extends from a common base body 103 of the connector device 100. In addition, each of the insertion elements 102 runs separately from the other insertion elements 102. The insertion elements 102 can be elastically deformed independently of one another in respect of the base body 103 and are arranged in such a way that when the insertion elements 102 are inserted into the contact hole, a plug connection can be provided between the connector device 100 and the circuit board.

The connector device 100 is shown in FIG. 1 in a side view, wherein two insertion elements 102 are visible. Behind these, a third or a fourth insertion element 102 may be disposed, for example. Each of the insertion elements 102 extends from a base body 103 of the connector device 100. Each of the insertion elements 102 may be elastically deformed in the contact hole in the installed state. This means that each of the insertion elements 102 tries to recover its initial position (non-deformed position). This impulse to recover into the initial position produces a force which can transfer to the internal surface of the contact hole, whereby a pressing force is generated, which results in the plug connection or interference fit/crimp connection between the connector device 100 and the circuit board.

Each one of the insertion elements 102 may extend at a particular angle from one another, i.e. not parallel to one another. This means that a gap between the insertion elements 102 increases in size towards the insertion element 111 starting from the base body 103. If the connector device 100 is inserted into the contact hole in the plug-in direction 111, to achieve this the insertion elements are first bent together and released once a final insertion position of the connector device 100 has been reached, so that the insertion elements 102 try to return to their initial position. This produces the pressing force required to produce an interference fit between the connector device 100 and the circuit board.

A further possibility for achieving a plug connection involves a central gap 106 being provided between the insertion elements 102. This may involve the insertion elements 102 extending in parallel from the base body 103, for example, in which case at least two of the at least three insertion elements 102 are spaced apart from one another by the gap 106. During the insertion of the insertion elements 102 into the contact hole, these are pressed together towards the gap, so that the insertion elements 102 can be inserted into the contact hole on account of the smaller diameter. Once the connector device 100 is adjacent to the desired position, the insertion elements 102 are released, so that they try to bend back to their initial position. This produces the force that leads to a pressing of the connector device 100 with the circuit board.

The position of the connector device 100 relative to the circuit board may be defined by a limit stop section 107, for example. The limit stop section may be an elevation, for example, which extends perpendicularly to the insertion or plug-in direction 111 or parallel to a surface of the circuit board. This increases the diameter of the connector device 100 region, at which the limit stop section 107 is defined, so that this region with the limit stop section 107 no longer passes through the contact hole and a continued movement in the insertion direction 111 can therefore be prevented.

The limit stop section 107 may be defined at the base body 103, for example, or also at all or also at only one of the insertion elements 102. As shown in FIG. 1, a limit stop section 107 is defined at the two insertion elements 102. This means that the connector device 100 can finally be inserted into the contact hole in the plug-in direction 111 until the limit stop section 107 abuts against the surface of the circuit board.

The section of the insertion elements 102, which is located in the contact hole when the insertion elements 102 are inserted into the contact hole, is defined as the insertion section 105. The insertion section 105 may be coated with a conductive layer, for example, or made entirely from a conductive material, so that apart from a mechanical interference fit, electrical conductivity can likewise be provided via the contact hole to the circuit board. The transfer region may therefore be defined on the one hand in the insertion section 105. On the other hand, the transfer region may also be provided at other contact regions of the connector device 100 with the circuit board. For example, a transfer region for transferring a current to the circuit board may be provided at the limit stop section 107.

As is further depicted in FIG. 1, the insertion section 105 may comprise a convex surface shape, for example. The convex surface shape is provided in particular at the side of a insertion element 102, said side facing an internal surface of the contact hole in the inserted state. The convex surface of the insertion section 105 increases the surface pressure, i.e. the force per unit area, between an insertion element 102 and the internal surface of the contact hole. A greater pressing force can thereby be achieved, so that the interference fit and therefore also the friction between the insertion elements 102 and the internal surface of the contact hole are increased.

The region of the connector device 100 which projects out of the contact hole in the insertion or plug-in direction 111 when the connector device 100 is in the inserted position in the contact hole, may be referred to as the end section 112 of the insertion elements 102. The free ends 104 of each of the insertion elements 102 are also located in this end section 112. The free ends 104 may be rounded, so that there is a reduced risk of them becoming wedged when the insertion elements 102 are inserted into the contact hole. In the end portion 112 there is a widening 108 on at least one of the insertion elements 102, which can act as an undercut when the insertion element 102 is inserted far enough into the contact hole. The widening 108 may create a snap-in connection of the insertion elements 102 with a surface of the circuit board. When the insertion elements are in the inserted state in the contact hole in the circuit board, the insertion elements 102 may snap outwards to a certain extent. Any movement against the insertion direction 111 is thereby blocked by the widenings 108, as they become wedged or jammed against the surface of the contact hole.

One solution to the wedging may be provided, for example, by the insertion elements 102 being pressed together in the end portion 112 and the connector device 100 being simultaneously moved against the insertion direction 111.

In addition, the widening 108 may comprise a first surface 109 with a sloping or oblique plane, so that the connector device 100 only needs to be moved against the insertion direction 111 in order to release the wedging. In other words, the oblique plane 109 of the first surface 109 forms a wedge shape of the widening 108, wherein the tip of the wedge points towards the contact hole when in the inserted position and the first surface or the oblique plane is extended outwardly in the insertion direction 111 starting from the tip of the wedge, so that the thickness of the insertion element 102 increases with the first surface 108 in the plug-in direction 111. In other words, the oblique plane, i.e. the plane of the first surface 109, may be at an angle relative to the plane of the circuit board surface, which may have a value of between 0 and 90°, wherein 0° means that the wedge area 109 is formed perpendicular to the insertion direction 111 and the angle 90° means that the first surface 109 may be formed parallel to the insertion direction 111.

The oblique plane of the wedge surface 109 causes that when the insertion elements 102 are pulled out against the insertion direction 111, a force is generated and transferred inwardly from the limit stop of the first surface 109 to the surface of the circuit board, in other words, to the centre point of the contact hole or towards the gap 106, so that the insertion elements 102 are automatically elastically deformed by a removal towards the gap 106. In this way, the cross-section of all insertion elements 102 is reduced to such a degree that the insertion elements including their undercuts 108 fit through the contact hole, so that the connector device 100 can be removed. It is possible to ensure by means of the wedge-shaped first surface that a greater force is required to remove the connector device from the contact hole against the insertion direction than is required for insertion.

The fastening region 101 to which the conductor 300 (see FIG. 3) is secured, for example by clamping means, may be disposed on the opposite side of the connector device 100 in relation to the insertion elements 102. As shown in FIG. 1, the fastening region 101 may comprise two clamping straps 110, which can be plastically deformed, for example, and can be placed around the conductor 300, so that a clamping force may be transferred to the conductor 300 and the conductor 300 can therefore be held by means of a clamping connection. The clamping straps 110 or other elements in the fastening region 101 may exhibit electrically conductive characteristics, so that a current can be conducted from the conductor 300 via the fastening region 101 to the transfer region.

The length of an insertion element 102 may be 8 to 12 mm (millimeters), for example. The diameter of an insertion element 102 may be 0.5 to 1 mm. The gap 106 between two insertion elements 102 may be selected between 0.5 mm and 0.8 mm. The insertion section 105 may comprise a length of 2.5 mm to 3 mm or the insertion section 105 may be adapted to a circuit board thickness.

Figure 2:
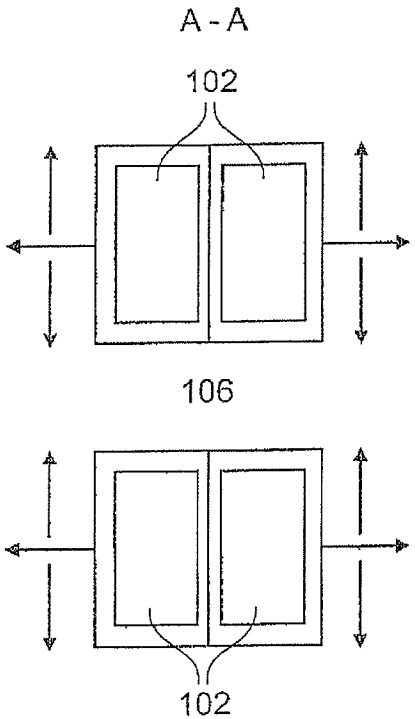
FIG. 2 shows a schematic sectional representation of four insertion elements in accordance with an exemplary embodiment of the present invention.

FIG. 2 shows the section A-A from FIG. 1. In the sectional representation A-A in FIG. 2, a top view of a connector device 100 with four insertion elements 102 is depicted. The four insertion elements 102 each form two pairs, wherein respectively two insertion elements 102 in each case are in contact with each other. The arrows in FIG. 2 represent the movement directions in which each of the insertion elements 102 are elastically deformed and can move individually and independently of the other. This elastic deformation may cause each of the insertion elements 102 to "splay out" at a given point in the internal surface of the contact hole. Even in the case of irregular, uncleanly formed contact holes, a mechanical connection and an electrical contact can be reliably made by means of the insertion elements 102. There must be a contact between the insertion elements 102 and the internal surface of the contact hole, in order to provide the mechanical connection (interference fit) on the one hand and, moreover, an electrical connection, for example.

In addition, the gap 106 which separates a first and a second group of insertion elements 102 is depicted in FIG. 2. The insertion elements 102 may be pressed together and may be elastically deformed in pairs in the direction of the gap 106, in order to be inserted into the contact hole.

Figure 3:
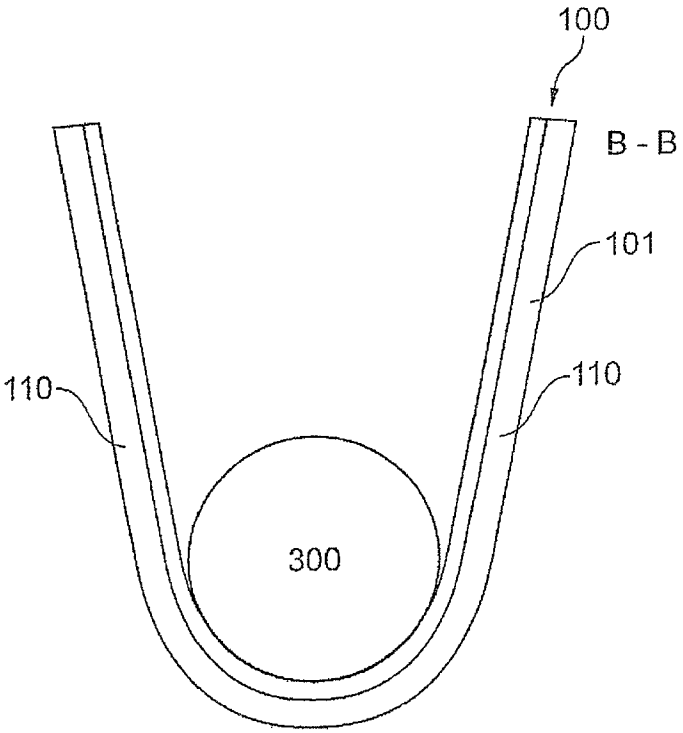
FIG. 3 shows a schematic sectional representation of a fastening region of the connector device in accordance with an exemplary embodiment of the present invention.

FIG. 3 shows the section B-B from FIG. 1, wherein a top view of the fastening region 100 of the connector device 100 is shown. In the fastening region 101 two clamping straps 110 are shown, which snuggle around the conductor 300. The clamping straps 110 may be designed to be plastically deformable and bendable around the conductor, so that a clamping force can be generated and the conductor 300 can be secured to the connector device 100 via a clamping connection.

Figure 4:
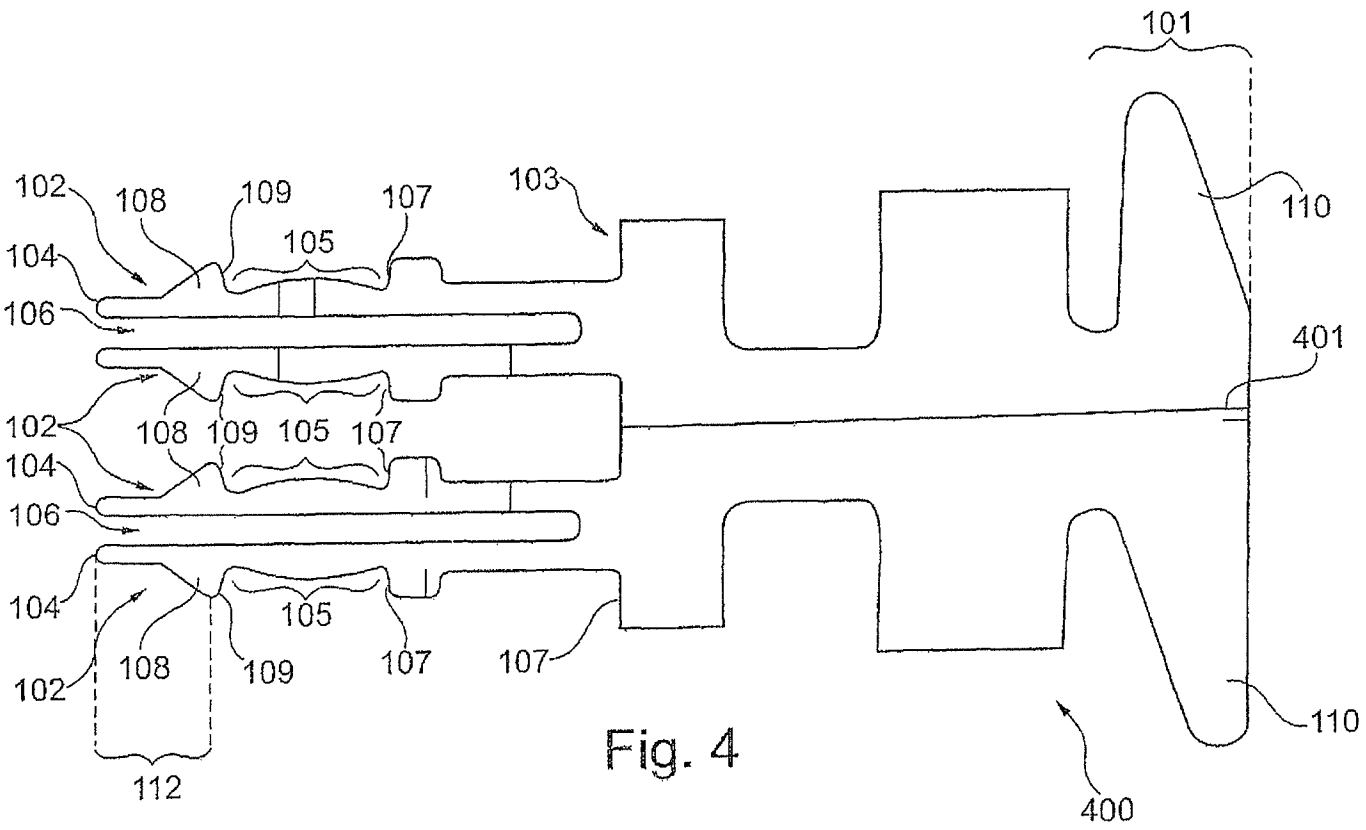
FIG. 4 shows a schematic representation of a semi-finished connector made from a foldable material in accordance with an exemplary embodiment of the present invention.

FIG. 4 shows an exemplary embodiment of a semi-finished connector 400 of the connector device 100. The semi-finished connector 400 may be made up of two halves, for example, which are separated by the bending line 401. The bending line 401 may represent a desired bending line, which may represent a preferred bending edge by means of perforation or material weakening, for example. In practice, the conductor may first be inserted in the fastening region 101, for example. Each half of the semi-finished connector 400 may then be bent along the bending line, so that both halves of the semi-finished connector 400 lie against one another. The clamping straps 110 of the semi-finished connector 400 may then be plastically deformed to fix the conductor 300, so that the conductor 300 is clamped by means of the clamping straps 110. When both halves of the semi-finished connector are in the folded-up state, the four insertion elements 102 depicted may lie against one another in pairs, for example, so that a cross-section is produced, as depicted in FIG. 2. The semi-finished connector 400 in this case may already comprise all further formations and features of the connector device 100. Hence, the semi-finished connector 400 may already comprise the base body 103 and the limit stop section 107. In addition, the semi-finished connector 400 already comprises the four insertion elements 102, including their insertion sections 105 and end sections 112. Likewise, the semi-finished connector may already comprise the widening 108, including the first surface 109 thereof. In addition, the semi-finished connector 400 already defines the gap 106 between the insertion elements 102 grouped later and the rounded-off free ends 104.

FIG. 5 shows a semi-finished connector 500 made from a foldable sheet metal material in accordance with another exemplary embodiment of the present invention.

By folding the semi-finished connector 500 along a symmetrical axis 510, a connector device similar to that shown in FIG. 6 is obtained. In relation to the description of further components of the semi-finished connector 500, reference is therefore made to the description of FIG. 6.

FIG. 6 shows a connector device 600 for the electrical connection of a conductor, which can be held by means of clamping straps 110, with a circuit board 602 shown in cross-section.

The connector device 600 comprises two pairs of insertion elements 502, 504 (see FIG. 5). The total of four insertion elements 502, 502, 504, 504 are jointly inserted into a single contact hole in the circuit board 602 and thereby resiliently compressed towards a centre axis 620. If the insertion sections 105 abut an electrically conductive contact 604 at the contact hole in the circuit board 602, the insertion sections 105 press outwardly and therefore represent an electrically conductive connection between the insertion sections 105 and the electrically conductive contact 604. If one end of the insertion elements 504 emerges from the contact hole and therefore from the circuit board 602, the insertion elements 504 are no longer compressed and they relax through an outward movement. This produces a locking effect.

To be more precise, one of the insertion elements 504 itself comprises the basic locking mechanism. This is based on the fact that when the connector device 600 is guided through the contact hole to secure the connector device 600 to the circuit board 602, the connector device 600 is locked to the circuit board 602 by means of a resilient barbed hook. The locking mechanism is unlocked by pressing the insertion elements 504 together repeatedly and then removing the connector device 600 from the contact hole in the circuit board 602. A reversible locking logic that can be used any number of times is thereby created.

A first of the insertion elements 502 comprises a convex insertion section 105, which is located within the contact hole and which is in direct contact with the electrically conductive contact 604 when the insertion elements 502, 504 are inserted into the contact hole. A second one of the insertion elements 504 has an insertion section 105, which extends from the base body 103 in the same way as the insertion section 105 of the first insertion element 502. The insertion section 105 of the second insertion element 504 is also located within the contact hole when the insertion elements 502, 504 are inserted into the contact hole. The second insertion element 504 also comprises a curved section 506, which extends from the insertion section 105 through the contact hole back as far as the insertion section 105 of the first of the insertion elements 502 and is separated from this by a narrow gap 1000 (cf. FIG. 10) of variable size. If the insertion elements 504 are pressed together laterally through the insertion into the contact hole, the size of the gap 1000 also reduces. If the insertion elements 504 spring back into the circuit board 602 following the insertion of the connector device 600 into the circuit board 602, the size of the gap 1000 increases again until the resilient system is again back in a force-free state. Consequently, the size of the gap 1000 diminishes initially during the insertion process of the connector device 600 into the circuit board 602 and increases again once the curved section 506 has emerged again from the circuit board 602. This causes a reversible locking. The locking mechanism is clearly created by a barbed hook, which is formed at the site of the essentially pear-shaped structure from the insertion elements 502, 504, at which point the interacting structure made up of the insertion elements 502, 504 is interrupted by the hole 1000.

A freely movable, rounded-off end portion 506*d* of the curved section 506 can be resiliently compressed during insertion of the connector device into the circuit board 602 and can be inserted through the contact hole and it springs back outwardly following an insertion through the contact hole, whereby the connector device 600 is automatically locked to the circuit board 602 by means of the end section 506*d*. The rounded end portion 506*d* of the curved section 506 forms a concave area, which abuts the convex insertion section 105 of the first insertion elements 502.

The curved section 506 contains two elongated sections 506*a*, 506*c* lying opposite one another and running parallel to one another, which are interconnected by a curve 506*b*, which lies opposite the insertion sections 105 of the first and second insertion elements 502, 504, spaced by the elongated sections 506*a*, 506*c*.

As shown in FIG. 5 and FIG. 6, two pairs of insertion elements 502, 504 are provided in total. These are disposed relative to one another with the semi-finished connector 500 in the folded state shown in FIG. 6, in such a manner that the locking mechanism following insertion of the connector device 600 into the circuit board 602 forms two barbed hooks on two sections of the contact hole opposite one another, said barbed hooks preventing the connector device 600 from being removed symmetrically from the circuit board 602. A third insertion element 502 corresponds in structural terms to the first insertion element 502. By contrast, a fourth insertion element 504 corresponds to the second insertion element 504.

The second and fourth insertion elements 504, 504 lie opposite one another axis-symmetrically. The corresponding symmetrical axis is oriented perpendicularly to the paper plane according to FIG. 9 and disposed in a focal point of the gap 106. This symmetrical axis corresponds to the centre axis 620 shown in FIG. 6. In a corresponding manner, the first and third insertion elements 502, 502 face one another in an axis-symmetrical manner.

The second and the fourth of the insertion elements 504, 504 lie adjacent to one another in an abutting manner and are thereby in contact. The second and the fourth of the insertion elements 504, 504 lie adjacent to one another in an abutting manner in an upper region according to FIG. 6. The first and the fourth of the insertion elements 502, 504 lie adjacent to one another contiguously in a lower region according to FIG. 6. The second and the third of the insertion elements 502, 504 lie adjacent to one another in an abutting manner in a lower region in accordance with FIG. 6.

As can be seen from FIG. 6, two movable arms can be obtained by folding the semi-finished connector 500, which can move outwardly when the connector device 600 is inserted into a contact hole in the circuit board 602 (cf. position 1). The snap-in hook of the curved section 504 has resilient properties and snaps at the circuit board 602 after correct fitting (cf. position 2). The bore edge of the circuit board 602 can be identified as position 3.

FIG. 7 shows a cross-sectional view of the connector device 600 along a sectional line A-A. FIG. 7 shows that in a rear section of the connector device 600, in which a cylindrical conductor or similar can be inserted, both folded halves remain at a certain distance from one another.

FIG. 8 shows a side view of the connector device 600. All insertion elements 502, 504 are worked out of a flat plate, particularly stamped from it. As shown in FIG. 8, the insertion elements 502, 504 of the connector device 600 therefore have a constant thickness in a direction that is oriented perpendicular to the spring direction of the curved section 506. Consequently, FIG. 8 shows that the two folded halves form an essentially cylindrical conductor insertion opening in the rear conductor insertion region of the connector device 600. In the front insertion or plug-in region of the connector device 600, by contrast, the plate sections folded on one another lie planar with contiguous contact.

FIG. 9 shows another cross-sectional view of the connector device 600 along a sectional line B-B. The relative position of the insertion elements 502, 502, 504, 505 at point B-B can be seen from FIG. 9.

Figure 10:
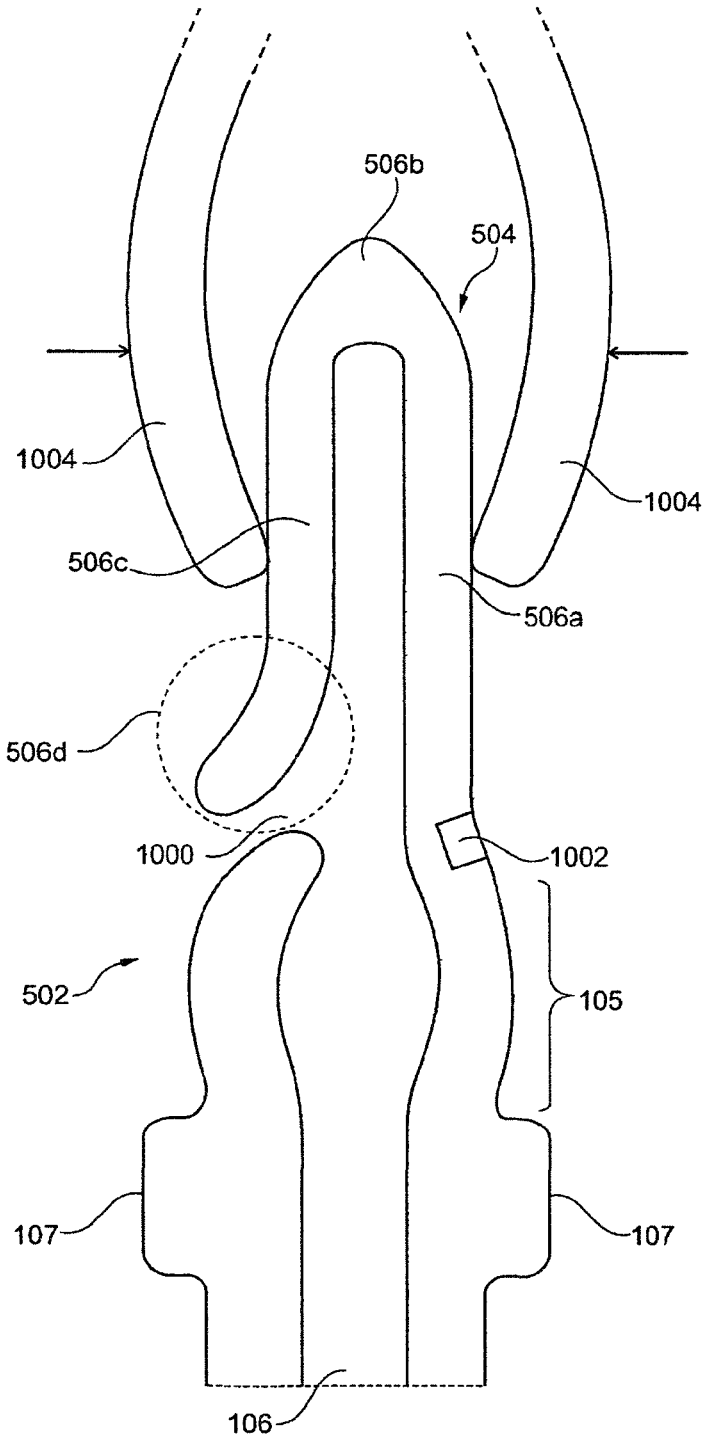
FIG. 10 shows an enlarged representation of a part of a connector arrangement, which is similar in design to FIG. 6 and exhibits a form tool and a connector device with a predetermined breaking point.

FIG. 10 shows an enlarged representation of a part of a connector device, which is formed in a similar manner to that in accordance with FIG. 6 and comprises a number of additional features.

In FIG. 10 a form tool 1004 (with two clamping jaws movable on one another) is shown schematically, which is set up to activate the connector device locked on the circuit board 602 in such a manner that the connector device locked on the circuit board 602 can be unlocked. To be more accurate, the form tool is set up to press together the connector device locked onto the circuit board 602, whereby the connector device locked onto the circuit board 602 is unlocked. The form tool 1004 is shown schematically in FIG. 10 in the form of two clamping jaws which can be moved towards one another along the arrows shown. The insertion elements 504 are thereby compressed, so that unlocking takes place. The form tool 104 may naturally be provided in very many alternative embodiments, insofar as it acts on the curved element 506 in such a manner that locking can be selectively deactivated.

Between the curved section 506 and the insertion section 105 of the insertion element 504 a predetermined breaking point 1002 is formed, which leads to a break between the curved section 506 and the insertion section 105 if a predefinable breaking load is exceeded. The predetermined breaking point 1002 is formed as a material weakness in the exemplary embodiment shown, i.e. as a thin point, but it may also take on many other embodiments or it may be disposed at another point. In particular, a predetermined breaking point 1002 may be contained in a transition from the electrical contact zone (insertion section 105) to the locking hook (curved section 506). The contact can thereby still be removed in case of emergency quasi forcibly, for example. The locking hook is released from the plug connection in this case and further locking, possibly even a re-insertion, is then no longer possible.

It should be noted in addition that "comprehensive" does not preclude other elements or steps and "a" does not preclude a multiplicity. It should further be noted that features or steps which have been described with reference to one of the above exemplary embodiments can also be used in combination with other features or steps of other exemplary embodiments described above. Reference numbers in the claims are not to be regarded as a limitation.

REFERENCE LIST

100 Connector device
101 Fastening region
102 Insertion element
103 Base body
104 Free end
105 Insertion section
106 Gap
107 Limit stop section
108 Widening
109 First surface
110 Strap
111 Insertion direction/plug-in direction
112 End section
300 Conductor
400 Semi-finished connector
401 Bending line
500 Semi-finished connector
502 First and third insertion element
504 Second and fourth insertion element
506 Curved section
506*a* Elongated section
506*b* Semicircular curve
506*c* Elongated section
506*d* Concave section
510 Symmetrical axis
600 Connector device
602 Circuit board
604 Electrically conductive contact
620 Centre axis
1000 Gap
1002 Predetermined breaking point
1004 Form tool

The invention claimed is:

1. An electrical connector device formed from a foldable plate for inserting into a hole of a circuit board, the device comprising:

a first connector half having a first set of insertion elements opposed to each other across a first gap formed between members of the first set of insertion elements, the first set of insertion elements and the first gap extending in a first direction beyond the foldable plate; and a second connector half having a second set of insertion elements opposed to each other across a second gap between members of the second set of insertion elements, the second set of insertion elements and the second gap extending in the first direction beyond the foldable plate, the first connector half and the second connector half opposed to one another about a bending line over the foldable plate, wherein after folding the first connector half and the second connector half along the bending line, a surface of the first set of insertion elements lies against a surface of the second set of insertion elements;

wherein the first set of insertion elements are parallel to one another and the second set of insertion elements are parallel to one another;

wherein at least one insertion element includes a limit stop section that extends in a direction perpendicular to the first direction, and an insertion section having a convex surface extending from the limit stop section.

2. The connector of claim 1, wherein the bending line is located along a longitudinal axis of the connector.

3. The connector of claim 1, wherein members of the first set of insertion elements and members of the second set of insertion elements are independently elastically deformable with respect to the foldable plate.

4. The connector of claim 1, wherein members of the first set of insertion elements and members of the second set of insertion elements extend from the foldable plate in an insertion direction.

5. The connector of claim 4, wherein members of the first set of insertion elements and members of the second set of insertion elements are elastically deformable in a direction transverse to the insertion direction.

6. The connector of claim 1, wherein at least one insertion element includes a free end opposed to the foldable plate, the free end having a rounded surface.

7. The connector of claim 1, wherein at least one insertion element has a surface that varies in a direction other than the first direction.

8. The connector of claim 1, wherein when the at least one insertion element is inserted in a contact hole, the convex surface contacts an internal surface of the contact hole.

9. The connector of claim 8, wherein the at least one insertion element includes an oblique plane adjacent to the convex surface.

10. The connector of claim 9, wherein the at least one insertion element includes a sloped surface that increases a width of the at least one insertion element in the direction perpendicular to the first direction.

11. The connector of claim 10, wherein the sloped surface intersects the oblique plane.

12. The connector of claim 1, wherein the bending line is substantially parallel to the first direction.

13. The connector of claim 1, wherein members of the first set of insertion elements include respective surfaces adjacent to the first gap that are substantially parallel with respect to each other in the first direction; and wherein members of the second set of insertion elements include respective surfaces adjacent to the second gap that are substantially parallel with respect to each other in the first direction.

14. The connector of claim 1, wherein members of the first set of insertion elements include respective opposed surfaces that vary in a direction transverse to the first direction; and wherein members of the second set of insertion elements include respective opposed surfaces that vary in a direction transverse to the first direction.

15. The connector of claim 1, wherein the at least one insertion element provides a solder-free contact.

16. The connector of claim 1, the first set of insertion elements being substantially symmetrical about the first gap;

the second set of insertion elements being substantially symmetrical about the second gap; and wherein the first and second sets of insertion elements provide an electrical loading capacity in accordance with ISO 16750-2, are jointly insertable into a contact hole with an insertion force of a maximum of 10 N, when in an inserted condition in the contact hole, provide a mechanical fastening force of at least 100 N, and are jointly removable from the contact hole.

17. The connector of claim 1, wherein the foldable plate is made from an electrically conductive material.

* * * * *